US007556483B2

(12) United States Patent
Gennami et al.

(10) Patent No.: US 7,556,483 B2
(45) **Date of Patent: *Jul. 7, 2009**

(54) ELECTRONIC COMPRESSOR HAVING A RESERVOIR CHAMBER AND AN OIL RETURN PASSAGE FOR CONNECTING THE RESERVOIR CHAMBER WITH A SUCTION CHAMBER

(75) Inventors: Hiroyuki Gennami, Kariya (JP); Kazuya Kimura, Kariya (JP); Ken Suitou, Kariya (JP); Kazuhiro Kuroki, Kariya (JP); Akihiko Taketani, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/494,392

(22) Filed: Jul. 26, 2006

(65) Prior Publication Data

US 2006/0263227 A1 Nov. 23, 2006

Related U.S. Application Data

(62) Division of application No. 10/815,204, filed on Mar. 30, 2004, now Pat. No. 7,101,160.

(30) Foreign Application Priority Data

Mar. 31, 2003 (JP) ..... 2003-097243
Mar. 31, 2003 (JP) ..... 2003-097244

(51) Int. Cl.
*F03C 2/00* (2006.01)
*F04C 18/00* (2006.01)

(52) U.S. Cl. ..... 418/55.6; 418/55.1; 418/55.4; 418/55.5; 418/57; 418/DIG. 1; 417/366; 417/410.1; 184/6.17

(58) Field of Classification Search ..... 418/55.1–55.6, 418/57, 270, DIG. 1; 417/366, 410.1; 184/6.16, 184/6.17
See application file for complete search history.

(56) References Cited

U.S. PATENT DOCUMENTS 5,468,130 A * 11/1995 Yamada et al. ..... 418/55.2
5,678,986 A 10/1997 Terauchi et al.
6,129,532 A 10/2000 Kato et al.
6,152,713 A 11/2000 Hisanaga et al.
6,234,768 B1 5/2001 Harakawa et al.
6,533,561 B1 3/2003 Furusho et al.

(Continued)

FOREIGN PATENT DOCUMENTS

JP 58117380 A * 7/1983 ..... 418/55.6

(Continued)

*Primary Examiner*—Theresa Trieu
(74) *Attorney, Agent, or Firm*—Locke Lord Bissell & Liddell LLP

(57) ABSTRACT

A compressor housing defines a motor accommodating chamber. The pressure in the motor accommodating chamber is equal to the pressure in a suction chamber. A first reservoir chamber is located in a discharge chamber. A second reservoir chamber is defined about the discharge chamber. A communicating passage connects the first reservoir chamber with the second reservoir chamber. A restrictor is located in the communicating passage. An oil return passage connects the second reservoir chamber with the suction chamber. A connecting passage connects the motor accommodating chamber with the suction chamber. Therefore, leakage of electricity is prevented.

17 Claims, 9 Drawing Sheets

U.S. PATENT DOCUMENTS

| | | | | |
|---|---|---|---|---|
| 6,599,110 | B2 * | 7/2003 | Gennami et al. | 418/55.6 |
| 6,872,063 | B2 * | 3/2005 | Kimura et al. | 418/55.5 |
| 7,101,160 | B2 * | 9/2006 | Gennami et al. | 418/55.5 |
| 7,264,453 | B2 * | 9/2007 | Gennami et al. | 418/55.5 |
| 2002/0134101 | A1 | 9/2002 | Gennami et al. | |

FOREIGN PATENT DOCUMENTS

| | | | | |
|---|---|---|---|---|
| JP | 60-256588 | | 12/1985 | |
| JP | 61-53488 | | 3/1986 | |
| JP | 05086483 | A * | 4/1993 | 427/305 |
| JP | 2002-285980 | | 10/2002 | |
| JP | 2002-285981 | | 10/2002 | |
| JP | 2002-285982 | | 10/2002 | |
| JP | 2002-295369 | | 10/2002 | |

* cited by examiner

ELECTRONIC COMPRESSOR HAVING A RESERVOIR CHAMBER AND AN OIL RETURN PASSAGE FOR CONNECTING THE RESERVOIR CHAMBER WITH A SUCTION CHAMBER

CROSS-REFERENCE TO RELATED APPLICATIONS

This application claims priority and is a divisional of U.S. patent application Ser. No. 10/815,204 filed on Mar. 30, 2004 now U.S. Pat. No. 7,101,160. The entirety of these priority applications is hereby incorporated in toto by reference.

BACKGROUND OF THE INVENTION

The present invention relates to an electric compressor used, for example, in a vehicle air conditioner.

A typical electric scroll compressor used in a vehicle air conditioner has a stationary scroll and a movable scroll. The stationary scroll is fixed to a housing, and has a base plate and a volute portion. The movable scroll has a base plate and a volute portion. The volute portions intermesh. When an electric motor accommodated in the housing is driven and the movable scroll orbits, each of compression chambers defined between the volute portions is moved toward the center of the volute portions, while the volume of the compression chamber is progressively decreased. Accordingly, refrigerant gas is compressed.

Japanese Laid-Open Patent Publication No. 2002-295369 discloses an electric scroll compressor that lubricates an orbiting mechanism that permits a movable scroll to orbit relative to a stationary scroll. The scroll compressor of the publication also improves the sealing property of compression chambers against a compression reaction force in a thrust direction applied to the movable scroll. Specifically, the scroll compressor has a back pressure chamber at the back side of the base plate of the movable scroll. The back pressure chamber surrounds the orbiting mechanism. Lubricating oil the pressure of which corresponds to a discharge pressure is retained in a bottom portion of a discharge chamber. The lubricating oil is guided to the back pressure chamber so that the movable scroll is urged toward the stationary scroll. Accordingly, the sealing property of the compression chambers is improved. In the electric scroll compressor of the publication, lubricating oil that lubricates the orbiting mechanism and increases the back pressure falls by the self weight down to a motor accommodating chamber through an oil bleed passage having a constriction. The lubricating oil is then temporarily retained in a reservoir formed in the bottom of the motor accommodating chamber. Thereafter, the lubricating oil is sent to a suction side of the compression mechanism, which includes the volute portions of the stationary scroll and the movable scroll, through a conveying passage.

When used in a vehicle air conditioner, the above described electric scroll compressor has the following drawbacks. The reservoir for lubricating oil is formed in the bottom of the motor accommodating chamber. Therefore, when a significant amount of liquid refrigerant returns to the compressor from a refrigeration circuit, mixture of the lubricating oil and the liquid refrigerant stays in the lubricating oil reservoir. The coils of the motor and other components can be impregnated with the mixture. In a typical electric compressor, polyol ester (POE) is used as lubricating oil, so that the lubricating oil exerts a sufficient insulating performance even if mixed with liquid refrigerant. An electric compressor using such lubricant oil has no drawbacks when applied to an ordinary air conditioner. However, in vehicle air conditioners, polyalkylene glycol (PAG) is predominantly used as lubricating oil for belt driven compressors. When mixed with liquid refrigerant, PAG significantly degrades the insulating property of the mixture liquid. When performing maintenance of such a vehicle air conditioner, PAG can be mixed with liquid refrigerant. If wire connections and stator coils are impregnated with such mixture of the lowered insulating property, leakage of electricity can occur.

Such leakage of electricity can occur not only in electric scroll compressors, but also in electric swash plate type compressors and electric vane compressors.

SUMMARY OF THE INVENTION

Accordingly, it is an objective of the present invention to provide an electric compressor that prevents leakage of electricity.

To achieve the above-mentioned objective, the present invention provides an electric compressor. The compressor includes an electric motor and a compression mechanism that is driven by the electric motor to compress gas. The compression mechanism includes a suction chamber and a discharge chamber A housing accommodates the compression mechanism. The housing defines a motor accommodating chamber that accommodates the electric motor. The pressure in the motor accommodating chamber is equal to the pressure in the suction chamber. A first reservoir chamber is located in the discharge chamber. A second reservoir chamber is defined about the discharge chamber. A communicating passage connects the first reservoir chamber with the second reservoir chamber. A restrictor is located in the communicating passage. An oil return passage connects the second reservoir chamber with the suction chamber. A connecting passage connects the motor accommodating chamber with the suction chamber.

In the above compressor, the second reservoir chamber is defined about the discharge chamber. However, according to another aspect of the invention, the second reservoir chamber may be located in the motor accommodating chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
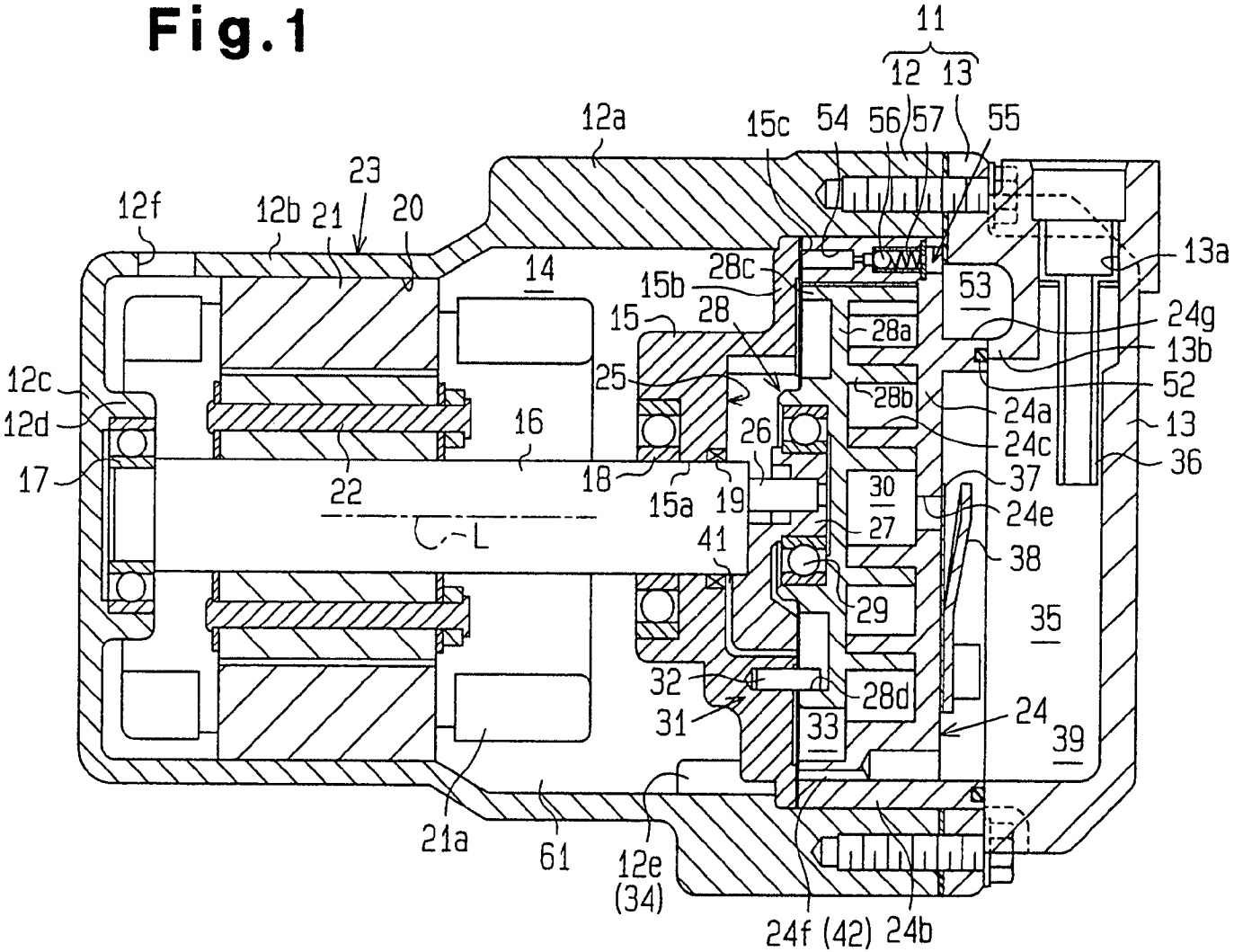
FIG. 1 is a longitudinal cross-sectional view illustrating an electric scroll compressor according to a first embodiment of the present invention.

In the drawings, like numerals are used for like elements throughout.

A first embodiment of the present invention will now be described with reference to the drawings.

As shown in FIG. 1, an electric scroll compressor used in a vehicle air conditioner has a compressor housing 11. The housing 11 is formed of a first housing member 12 and a second housing member 13, which are aluminum alloy castings fastened to each other with bolts. The first housing member 12 is shaped like a horizontally oriented cylinder and includes a large diameter portion 12*a*, a small diameter portion 12*b*, and an end wall 12*c*. The small diameter portion 12*b* is integrally formed with the large diameter portion 12*a* at the left end of the large diameter portion 12*a*. The end wall 12*c* is integrally formed with the left end of the small diameter portion 12*b*, thereby closing the left end of the small diameter portion 12*b*. The second housing member 13 is shaped like a horizontally oriented cylinder with one end closed. A sealed space 14 is defined in the housing 11. The sealed space 14 is encompassed by the housing members 12, 13.

A cylindrical shaft supporting portion 12*d* extends from a center portion of the inner surface of the end wall 12*c*, which is a part of the first housing member 12. A shaft supporting member 15 is fitted and fixed to an open end of the large diameter portion 12*a* of the first housing member 12. The shaft supporting member 15 functions as a partition member, or a stationary wall, and has a through hole 15*a* in the center. A rotary shaft 16 is accommodated in the first housing member 12. The left end of the rotary shaft 16 is rotatably supported by the shaft supporting portion 12*d* with a bearing 17 in between. The right end of the rotary shaft 16 is rotatably supported by the through hole 15*a* of the shaft supporting member 15 with the bearing 18 in between. A sealing member 19 is located between the shaft supporting member 15 and the rotary shaft 16 to seal the rotary shaft 16. Accordingly, a motor accommodating chamber 20 is defined in a left portion of the sealed space 14 as viewed in FIG. 1. The shaft supporting member 15 is a wall of the motor accommodating chamber 20.

In the motor accommodating chamber 20, a stator 21 having a coil 21*a* is located on the inner surface of the small diameter portion 12*b* of the first housing member 12. In the motor accommodating chamber 20, a rotor 22 is fixed to the rotary shaft 16. The rotor 22 is located radially inward of the stator 21. The small diameter portion 12*b*, the shaft supporting member 15, the rotary shaft 16, the stator 21, and the rotor 22 form an electric motor 23. An axis of rotation of the motor 23 extends horizontally. The rotation axis coincides with an axis L of the rotary shaft 16. When electricity is supplied to the coil 21*a* of the stator 21, the rotary shaft 16 and the rotor 22 rotate integrally.

In the first housing member 12, a stationary scroll 24 is located at the open end of the large diameter portion 12*a*. The stationary scroll 24 includes a disk-shaped base plate 24*a*, a circumferential wall 24*b*, and a volute portion 24*c*. The circumferential wall 24*b* is integrally formed with and arranged lateral to the base plate 24*a*. The volute portion 24*c* is also integrally formed with the base plate 24*a*. The stationary base plate 24*a* includes a first stationary face (left end face as viewed in FIG. 1) and a second stationary face, or a back face (right end face as viewed in FIG. 1). The stationary volute portion 24*c* extends from the first stationary face, and the second stationary face is opposite from the first stationary face. A flange portion 15*b* is integrally formed with the outer circumferential portion of the shaft supporting member 15. The stationary scroll 24 contacts the flange portion 15*b* at the distal end face of the circumferential wall 24*b* (see FIG. 4). Therefore, in the sealed space 14, the base plate 24*a* and the circumferential wall 24*b* of the stationary scroll 24, the shaft supporting member 15, and the sealing member 19 sealing the rotary shaft 16 define a scroll accommodating chamber 25 between the shaft supporting member 15 and the stationary scroll 24.

Figure 4:
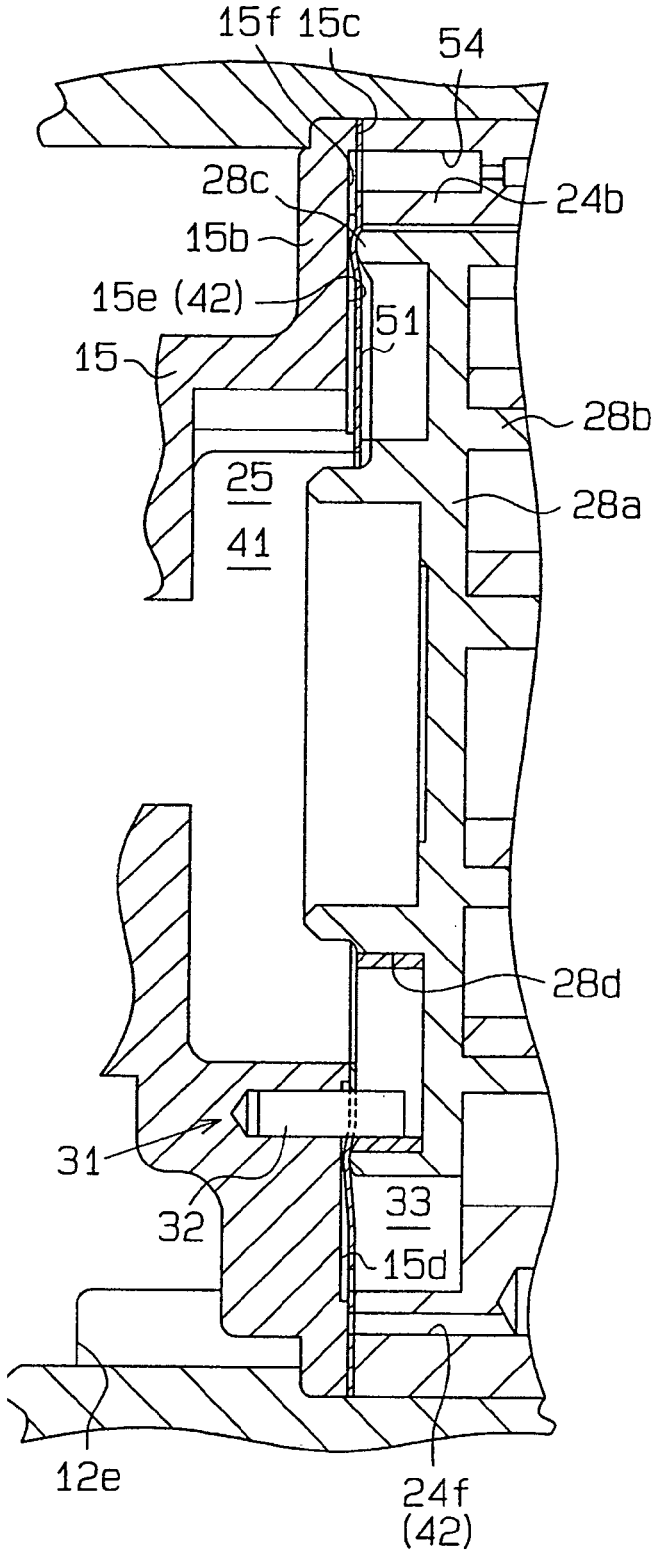
FIG. 4 is an enlarged longitudinal cross-sectional view illustrating a section including a back pressure chamber and an elastic body of the compressor shown in FIG. 1.

An eccentric shaft 26 is located at the distal end face of the rotary shaft 16. The eccentric shaft 26 is displaced from the axis L of the rotary shaft 16 and is located in the scroll accommodating chamber 25. A bushing 27 is fitted and fixed to the eccentric shaft 26. A movable scroll 28 is accommodated in the scroll accommodating chamber 25. The movable scroll 28 is rotatably supported by the bushing 27 with a bearing 29 in between such that the movable scroll 28 faces the stationary scroll 24. The movable scroll 28 includes a disk-shaped movable base plate 28*a* and a movable volute portion 28*b*. The movable base plate 28*a* includes a first movable face (right end face as viewed in FIG. 1) and a second movable face, or a back face (left end face as viewed in FIG. 1). The movable volute portion 28*b* extends from the first movable face, and the second movable face is opposite from the first movable face. The movable volute portion 28*b* is integrally formed with the base plate 28*a*. As shown in FIG. 4, an annular projection 28*c*, which is annular when viewed along a thrust direction, is integrally formed with the base plate 28*a* on the peripheral portion. The annular projection 28*c* faces the flange portion 15*b*. The surface of the movable scroll 28 is plated with nickel phosphorus (Ni—P).

The stationary scroll 24 and the movable scroll. 28 intermesh at the volute portions 24*c*, 28*b* in the scroll accommodating chamber 25. The distal end face of each of the volute portions 24*c*, 28*b* contacts the base plate 28*a*, 24*a* of the other scroll 28, 24. Therefore, the base plate 24*a* and the stationary volute portion 24*c* of the stationary scroll 24 and the base plate 28*a* and the movable volute portion 28*b* of the movable scroll 28 define a compression chamber 30 in the scroll accommodating chamber 25.

Anti-rotation mechanism 31 is provided between the base plate 28*a* of the movable scroll 28 and the shaft supporting member 15, which faces the base plate 28*a*. The anti-rotation mechanism 31 includes circular holes 28*d* formed in the peripheral portion of the back of the base plate 28*a* of the movable scroll 28 and pins 32 (only one is shown in the drawing) projecting from the flange portion 15*b* of the shaft supporting member 15. The pins 32 are loosely fitted in the circular holes 28*d*.

Figure 2:
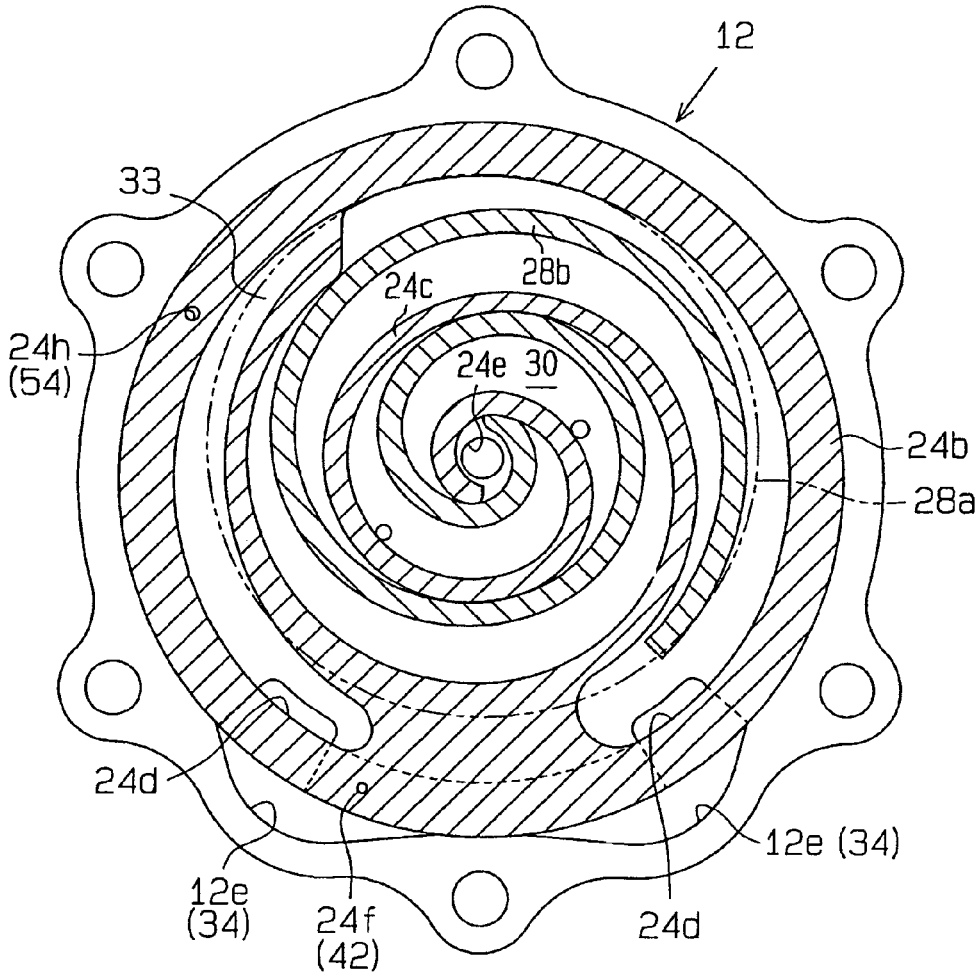
FIG. 2 is a transverse cross-sectional view illustrating a compression mechanism of the electric scroll compressor shown in FIG. 1.
Figure 3:
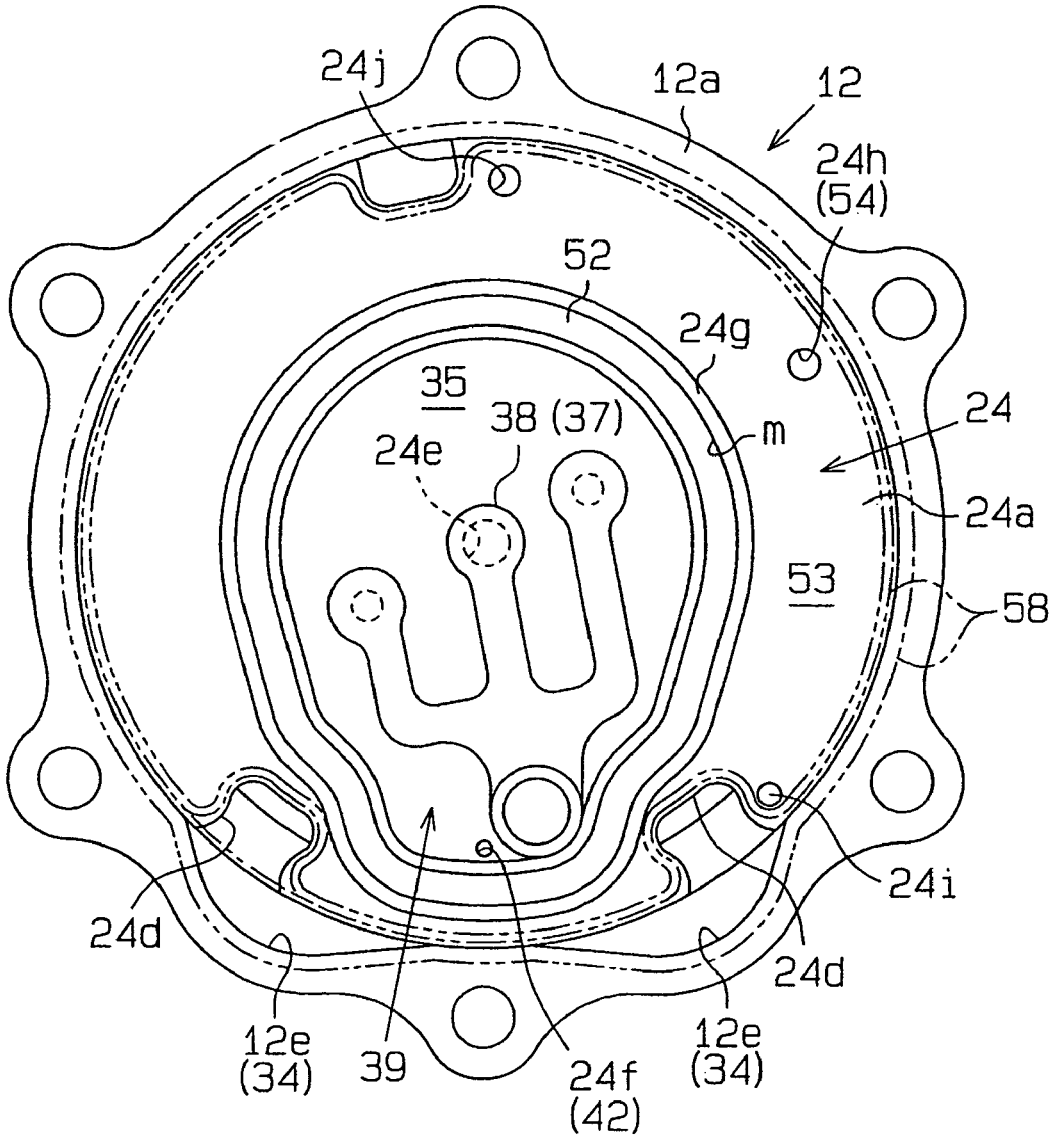
FIG. 3 is a transverse cross-sectional view illustrating a discharge chamber of the electric scroll compressor shown in FIG. 1.
Figure 5:
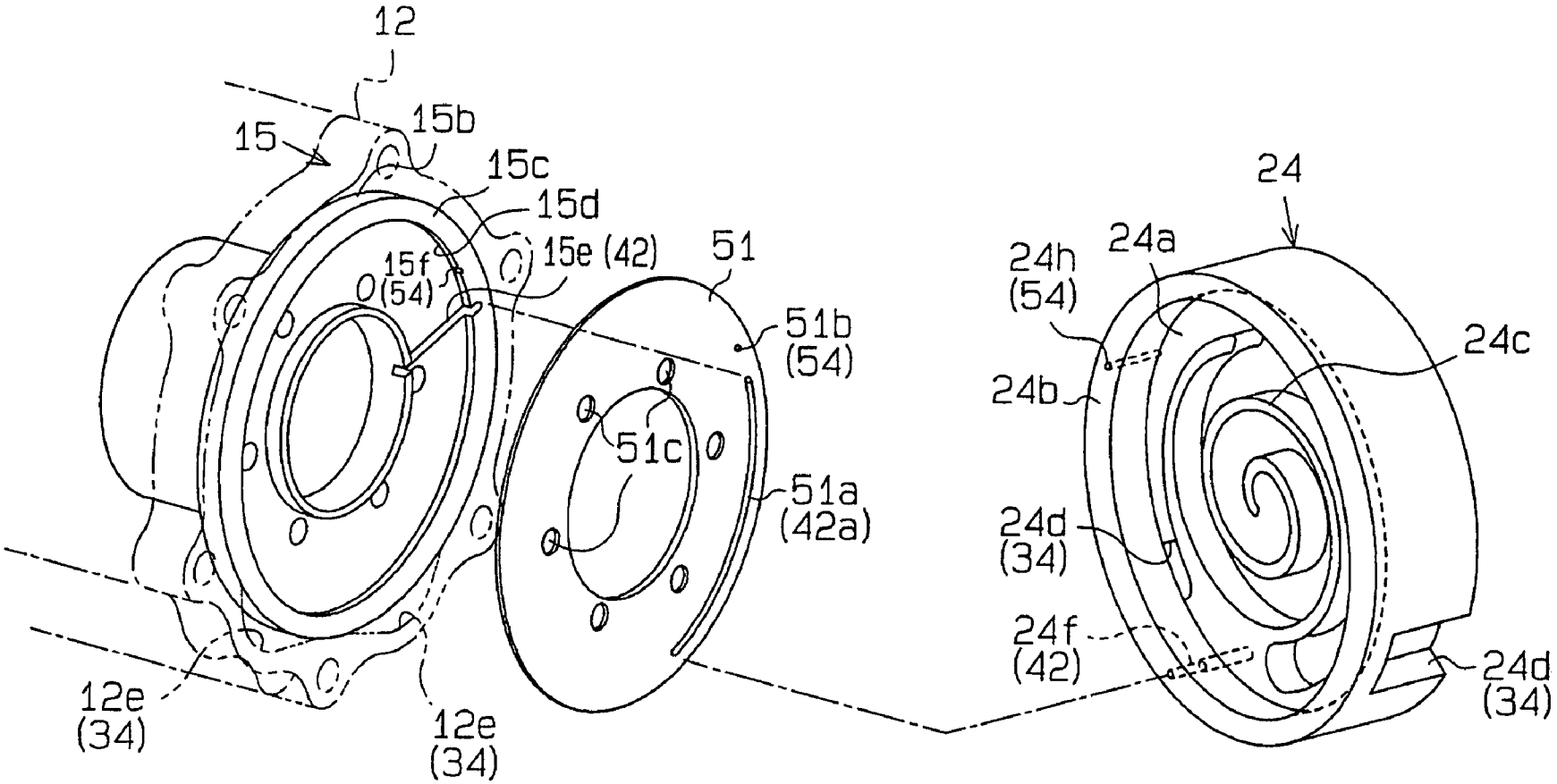
FIG. 5 is an exploded perspective view illustrating the shaft supporting member, the elastic body, and the stationary scroll shown in FIG. 1.

In the scroll accommodating chamber 25, a suction chamber 33 is defined between the circumferential wall 24*b* of the stationary scroll 24 and the outermost portion of the movable volute portion 28*b* of the movable scroll 28. In a lower portion of the circumferential wall 24*b* of the stationary scroll 24, symmetric two recesses 24*d* are formed as shown in FIGS. 2, 3 and 5. In an inner lower surface of the large diameter portion 12*a* of the first housing member 12, symmetrical two recess 12*e* are formed to correspond to the recesses 24*d*. A space between the inner surfaces of the recesses 12*e* and the outer surface of the flange portion 15*b* of the shaft supporting member 15, and the recesses 24*d* of the circumferential wall 24*b* define a connecting passage 34 that connects a bottom portion, which is the lowest portion of the motor accommodating chamber 20 with the suction chamber 33.

That is, the connecting passage 34 is formed by denting a portion of the inner surface of the first housing member 12 that faces the outer surface of the stationary scroll 24. The connecting passage 34 extends between the inner surface of the first housing member 12 and the outer surface of the stationary scroll 24. The connecting passage 34 extends horizontally for a certain length from the bottom portion of the motor accommodating chamber 20 toward a lower portion of the suction chamber 33, and then extends upward toward the suction chamber 33. The lowest portion of the inner surface of the recess 12*e*, that is, the lowest section of a face defining the connecting passage 34 is located lower than the lowest part of the motor 23.

As shown in FIG. 1, in a left outer portion of the small diameter portion 12*b* of the first housing member 12 as viewed in FIG. 1, a suction port 12*f* is formed to permit the motor accommodating chamber 20 to communicate with the outside. An external pipe is connected to the suction port 12*f*. The external pipe is connected to an evaporator of an external refrigerant circuit (not shown). Therefore, low pressure refrigerant gas is drawn into the suction chamber 33 from the external refrigerant circuit through the suction port 12*f*, the motor accommodating chamber 20 and the connecting passage 34. The suction port 12*f*, the motor accommodating chamber 20 and the connecting passage 34 form a suction passage. Although not illustrated, grooves extending in a thrust direction are formed on the outer circumferential surface of the stator 21. The grooves function as passages for refrigerant gas.

A discharge chamber 35 is defined between the second housing member 13 and the stationary scroll 24. A discharge hole 24*e* is formed in a center portion of the base plate 24*a* of the stationary scroll 24. The discharge hole 24*e* connects the compression chamber 30 with the discharge chamber 35 when the compression chamber 30 is at the center of the scrolls 24, 28. In the discharge chamber 35, a discharge valve 37, which is a reed valve, is provided on the stationary scroll 24 to open and close the discharge hole 24*e*. The opening degree of the discharge valve 37 is limited by a retainer 38 fixed to the stationary scroll 24. A discharge port 13*a* is formed in the second housing member 13. The discharge port 13*a* communicates with the discharge chamber 35. An external pipe is connected to the discharge port 13*a*. The external pipe is connected to a cooler of the external refrigerant circuit (not shown). An oil separator 36 is attached to the discharge port 13*a* to separate lubricating oil from high pressure refrigerant gas. Therefore, high pressure refrigerant gas in the discharge chamber 35 is discharged to the external refrigerant circuit through the discharge port 13*a* after the oil separator separates lubricating oil from the refrigerant gas. A first reservoir chamber 39 is formed in a bottom portion of the discharge chamber 35 to retain lubricating oil that has been separated from refrigerant by the oil separator 36.

When the rotary shaft 16 is rotated by the electric motor 23, the movable scroll 28 is caused to orbit about the axis (the axis L of the rotary shaft 16) by the eccentric shaft 26. The axis of the stationary scroll 24 coincides with the axis L of the rotary shaft L. The movable scroll 28 is prevented from rotating by the anti-rotation mechanism 31, but is only permitted to orbit. The orbiting motion of the movable scroll 28 moves the compression chamber 30 from an outer portion of the volute portions 24*c*, 28*b* of the scrolls 24, 28 toward the center while decreasing the volume of the compression chamber 30. Accordingly, low pressure refrigerant that has been drawn into the compression chamber 30 from the suction chamber 33 is compressed. The compressed high pressure refrigerant gas is discharged to the discharge chamber 35 through the discharge hole 24*e* while opening the discharge valve 37.

As shown in FIGS. 1 and 4, a back pressure chamber 41 is defined in the scroll accommodating chamber 25 at the back of the base plate 28*a* of the movable scroll 28. The back pressure chamber 41 and the first reservoir chamber 39, which is located in a lower portion of the discharge chamber 35, or a discharge pressure zone, are connected with each other by a pressurized oil supply passage 42. The pressurized oil supply passage 42 has a constriction 42*a* (see FIG. 5). The high pressure lubricating oil containing a small amount of refrigerant gas is supplied to the back pressure chamber 41 from the first reservoir chamber 39 at a bottom portion of the discharge chamber 35 and urges the movable scroll 28 toward the stationary scroll 24.

As shown in FIGS. 1, 4 and 5, in the scroll accommodating chamber 25, an elastic body 51, which is a doughnut-shaped plate, is located between the flange portion 15*b* of the shaft supporting member 15 and the circumferential wall 24*b* of the stationary scroll 24. The elastic body 51 is made, for example, of metal such as carbon steel. A peripheral portion of the elastic body 51 is held between the flange portion 15*b* of the shaft supporting member 15 and the circumferential wall 24*b* of the stationary scroll 24, so that the elastic body 51 is fixed in the scroll accommodating chamber 25. Pin holes 51*c* are formed in an inner portion of the elastic body 51. The pins 32 of the anti-rotation mechanism 31 are inserted in the pin holes 51*c*.

As shown in FIG. 5, an arcuate elongated hole 51*a* is formed in a peripheral portion of the elastic body 51. The elongated hole 51*a* and a space encompassed by a contact surface 15*c* of the flange portion 15*b* of the shaft supporting member 15 and a distal end face of the circumferential wall 24*b* of the stationary scroll 24 form a section (constriction 42*a*) of the pressurized oil supply passage 42 connecting the first reservoir chamber 39 with the back pressure chamber 41. The lower end of the elongated hole 51*a* is connected with the first reservoir chamber 39 by an oil passage 24*f* formed in the circumferential wall 24*b* of the stationary scroll 24. The upper end of the elongated hole 51*a* is connected with the back pressure chamber 41 by a wide annular groove 15*d* and a linear groove 15*e*, which are formed in the contact surface 15*c* of the shaft supporting member 15. The oil passage 24*f*, the elongated hole 51*a*, and the grooves 15*d*, 15*e* form the pressurized oil supply passage 42.

As shown in FIG. 4, the elastic body 51 is installed while being elastically deformed by the annular projection 28*c* of the movable scroll 28. The elasticity of the elastic body 51 maintains the sealing property between the elastic body 51 and the contact surface of the annular projection 28*c*, and urges the movable scroll 28 toward the stationary scroll 24. Therefore, the elastic body 51 and the annular projection 28*c* seal the back pressure chamber 41 and the suction chamber 33 from each other.

FIG. 3 illustrates a state where the second housing member 13 is removed from the open end of the large diameter portion 12*a* of the first housing member 12. As shown in FIGS. 1 and 3, a dividing wall 24*g*, which is shaped like a closed ring, is integrally formed with the base plate 24*a* of the stationary scroll 24. The dividing wall 24*g* projects from the back of the base plate 24*a*. A dividing wall 13*b*, which corresponds to the dividing wall 24*g*, is integrally formed with the second housing member 13 on an inner surface. As shown in FIG. 3, an accommodating groove m is formed in the distal end face of the dividing wall 24*g*. A seal ring 52 is fitted in the groove m to seal the distal end face of the dividing wall 13*b*. As shown in FIGS. 1 and 3, the discharge chamber 35 is defined inward of the dividing walls 24*g*, 13*b*. A second reservoir chamber 53 is defined between the circumferential surfaces of the dividing walls 24*g*, 13*b* and the inner surface of the second housing member 13. The second reservoir chamber 53 and the back pressure chamber 41 are connected with each other by an oil bleed passage 54 formed in the flange portion 15*b* of the shaft supporting member 15 and the circumferential wall 24*b* of the stationary scroll 24. As shown in FIG. 5, the oil bleed passage 54 includes a recess 15*f*, a hole 51*b*, and a passage 24*h*. The recess 15*f* is formed in the contact surface 15*c* of the shaft supporting member 15 and communicates with the groove 15*d*. The hole 51*b* extends through a peripheral portion of the elastic body 51 and corresponds to the recess 15*f*. The passage 24*h* is formed in the circumferential wall 24*b* of the stationary scroll 24 to correspond to the hole 51*b*. The pressurized oil supply passage 42, the back pressure chamber 41 and the oil bleed passage 54 function as a communicating passage that connects the first reservoir chamber 39 with the second reservoir chamber 53.

As shown in FIG. 1, an adjuster valve 55 is located in a section of the oil bleed passage 54, or a section of the passage 24*h*, in the circumferential wall 24*b* of the stationary scroll 24. The adjuster valve 55 adjusts the opening degree of the oil bleed passage 54 according to the difference between the pressure in the back pressure chamber 41 and the pressure in the second reservoir chamber 53. The adjuster valve 55 includes a ball valve 56 and a coil spring 57, and operates to maintain the pressure difference between the back pressure chamber 41 and the second reservoir chamber 53 to a constant value. Therefore, when the electric scroll compressor operates normally, the adjuster valve 55 maintains the pressure in the back pressure chamber 41, or an urging force of the movable scroll 28 based on the pressure in the back pressure chamber 41, to a constant value. Further, lubricating oil in the back pressure chamber 41 is sent to the second reservoir chamber 53 through the oil bleed passage 54 and the adjuster valve 55 and retained in the second reservoir chamber 53. The adjuster valve 55 functions as a check valve to prevent backflow of oil from the second reservoir chamber 53 to the back pressure chamber 41.

As shown in FIG. 3, an oil return passage 24*i* is formed in the base plate 24*a* of the stationary scroll 24. The oil return passage 24*i* connects the bottom portion of the second reservoir chamber 53 with the bottom portion of the suction chamber 33. A gas return passage 24*j* is formed in the base plate 24*a* to connect an upper portion of the second reservoir chamber 53 with an upper portion of the suction chamber 33. The gas return passage 24*j* returns gas separated from lubricating oil retained in the second reservoir chamber 53 to the suction chamber 33. Therefore, lubricating oil retained in the second reservoir chamber 53 is drawn to the suction chamber 33 through the oil return passage 24*i* by a suction effect based on, orbiting motion of the movable scroll 28. The lubricating oil is then drawn into the compression chamber 30 with refrigerant gas to lubricate sliding surfaces of the compression mechanism. Further, refrigerant gas separated from lubricating oil stays in an upper portion of the second reservoir chamber 53 and is returned to the suction chamber 33 through the gas return passage 24*j*.

Since the recesses 24*d* forming the connecting passage 34 is formed in the base plate 24*a* as shown in FIG. 3, the shape of the outer contact surface of the second housing member 13 is determined to define the recesses 24*d* and the second reservoir chamber 53. As shown by alternate long and two short dashes lines in FIG. 3, a partition gasket 58 is located between the outer contact surface and the open end face of the large diameter portion 12*a* of the first housing member 12.

As shown in FIG. 1, an accommodating recess 61 is formed by bulging a bottom portion of the large diameter portion 12*a* of the first housing member 12 downward. The accommodating recess 61 is capable of retaining a predetermined amount of lubricating oil and liquid refrigerant below the coil 21*a*.

The above embodiment provides the following advantages.

(1) The discharge chamber 35 is defined between the second housing member 13 and the base plate 24*a* of the stationary scroll 24. The second reservoir chamber 53 is defined outside of the discharge chamber 35. Lubricating oil is supplied to the second reservoir chamber 53 from the back pressure chamber 41 through the oil bleed passage 54 and the adjuster valve 55, and is temporarily retained in the second reservoir chamber 53. Therefore, lubricating oil is supplied from the second reservoir chamber 53 to the suction chamber 33 through the oil return passage 24*i*. This prevents lubrication from being insufficient. In other words, the sliding surfaces of the compression mechanism are reliably lubricated.

(2) Part of the second housing member 13, or the dividing walls 13*b* that defines the second reservoir chamber 53 covers the base plate 24*a* of the stationary scroll 24. This reduces the area of the base plate 24*a* that faces the discharge chamber 35. Accordingly, force applied to the base plate 24*a* due to the discharge pressure is decreased. The configuration thus prevents the base plate 24*a* from being deformed. Therefore, the sealing property of the end face of the stationary volute portion 24*c* of the stationary scroll 24 and the sliding surface of the base plate 28*a* of the movable scroll 28 are prevented from being degraded. Accordingly, the compression efficiency is prevented from being degraded.

(3) Conventionally, a low pressure gas zone is used for retaining suction refrigerant gas and given no additional functions. In the illustrated embodiment, the low pressure gas zone is used as the second reservoir chamber 53. Therefore, there is no need for providing dedicated components for the second reservoir chamber 53. This reduces the manufacturing cost.

(4) Lubricating oil is retained in the second reservoir chamber 53. The configuration prevents lubricating oil from the back pressure chamber 41 from being retained in a bottom portion of the motor accommodating chamber 20. Although refrigerant gas is drawn into the motor accommodating chamber 20 in the electric scroll compressor of the illustrated embodiment, liquid refrigerant is not mixed with two or more kinds of lubricating oils unlike the compressor mentioned in the prior art section. Thus, no mixed liquid having a lowered insulating property is produced. Therefore, the illustrated embodiment prevents leakage of electricity caused by such mixed liquid, which would be produced due to defects of the coil 21*a* of the electric motor 23.

(5) The motor accommodating chamber 20 functions as a part of the suction passage for refrigerant gas, and also sends refrigerant gas from a bottom portion of the motor accommodating chamber 20 to the suction chamber 33. Therefore, during a normal operation of the compressor, lubricating oil and liquid refrigerant are drawn into the suction chamber 33 together with refrigerant gas. This effectively prevents lubricating oil and liquid refrigerant from staying in the motor accommodating chamber 20. Accordingly, leakage of electricity due to mixed liquid having a lowered insulating property is further effectively prevented at the coil 21*a* of the electric motor 23.

(6) The large diameter portion 12*a* is provided at the opening end of the small diameter portion 12*b*, which defines the motor accommodating chamber 20. The accommodating recess 61 for retaining lubricating oil is formed in a lower part of the large diameter portion 12*a*. When the compressor is temporarily stopped, lubricating oil and liquid refrigerant can be retained in the motor accommodating chamber 20 due to the physical property of the air conditioner. Even if this is the case, the illustrated embodiment prevents the coil 21*a* from being impregnated with the mixed liquid. When the compressor is started again, leakage of electricity is prevented.

(7) The surface of the movable scroll 28 is plated with nickel phosphorus (Ni—P). When a high-speed operation of the compressor is continued, lubrication will be insufficient in the compressor. Even if this is the case, the plated surface of the movable scroll 28 increases the durability of the sliding surfaces of the stationary scroll 24 and the movable scroll 28.

(8) The movable scroll 28 is urged toward the stationary scroll 24 by high pressure refrigerant gas supplied to the back pressure chamber 41. That is, the movable scroll 28 is urged toward the stationary scroll 24 not only by the urging force generated by elastic deformation of the elastic body 51, but also by the urging force generated by the pressure of the back pressure chamber 41. These urging forces reliably act against the compression reaction force in the thrust direction acting on the movable scroll 28 during a normal operation of the electric compressor. Thus, in the illustrated embodiment, in which sealing members (for example, chip seals) are not provided on the end faces of the volute portions 24*c*, 28*b*, the compression chamber 30 is reliably sealed.

A second embodiment of the present invention will now be described.

The differences between the first embodiment and the second embodiment will mainly be discussed below, and like or the same reference numerals are given to those components that are like or the same as the corresponding components of the first embodiment.

Figure 6:
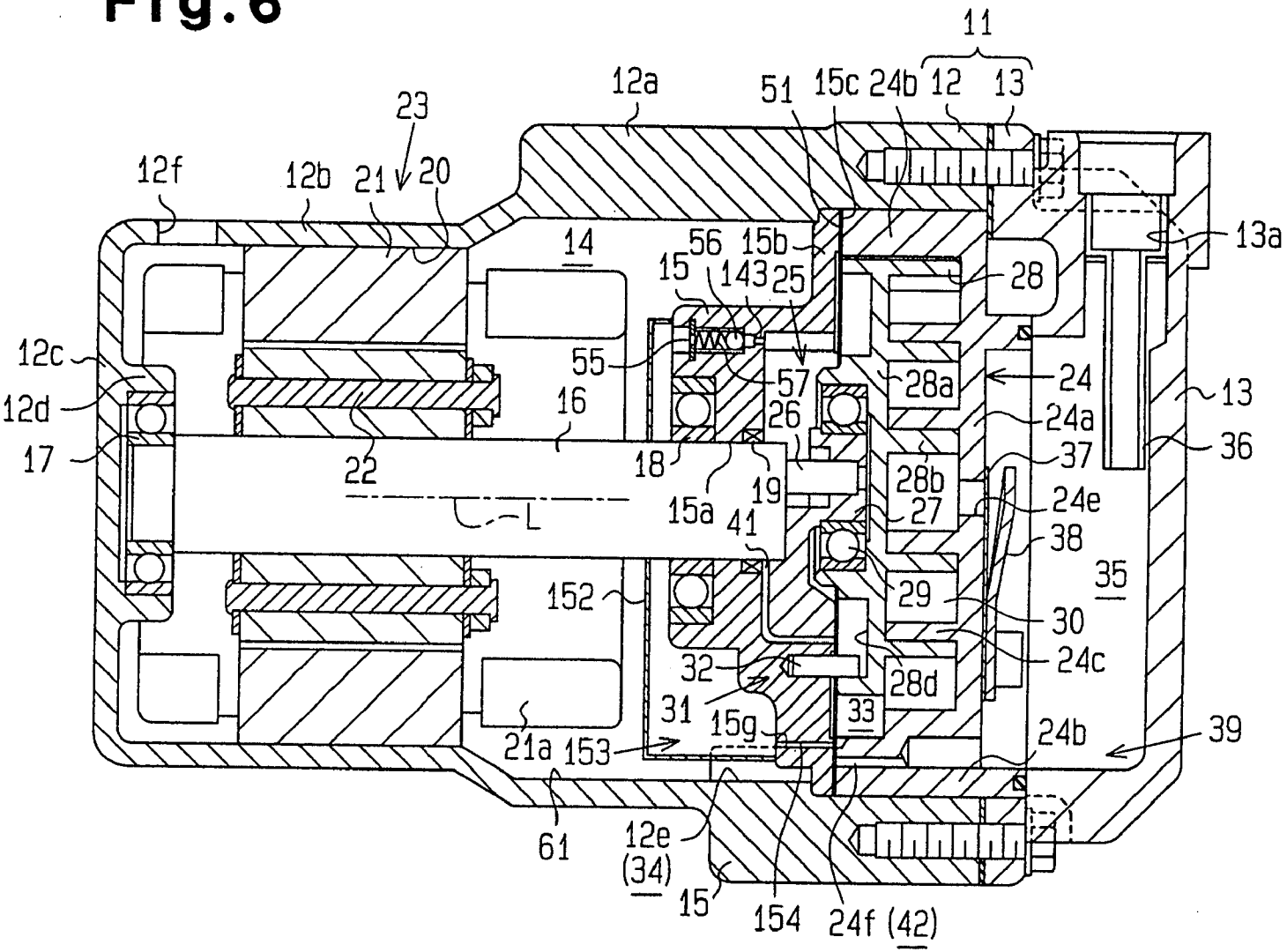
FIG. 6 is a longitudinal cross-sectional view illustrating an electric scroll compressor according to a second embodiment of the present invention.

As shown in FIG. 6, the oil bleed passage 54 in the first embodiment is omitted from the stationary scroll 24. An oil bleed passage 143 is formed in the shaft supporting member 15 to connect the back pressure chamber 41 and the motor accommodating chamber 20 (suction pressure zone) to each other. An adjuster valve 55 is located in the oil bleed passage 143 of the shaft supporting member 15. The adjuster valve 55 adjusts the opening degree of the oil bleed passage 143 according to the difference between the pressure in the back-pressure chamber 41 and the pressure in the motor accommodating chamber 20. The adjuster valve 55 operates to maintain the pressure difference between the back pressure chamber 41 and the motor accommodating chamber 20 to a constant value. Therefore, when the electric scroll compressor operates normally, the adjuster valve 55 maintains the pressure in the back pressure chamber 41 to a constant value.

Figure 9:
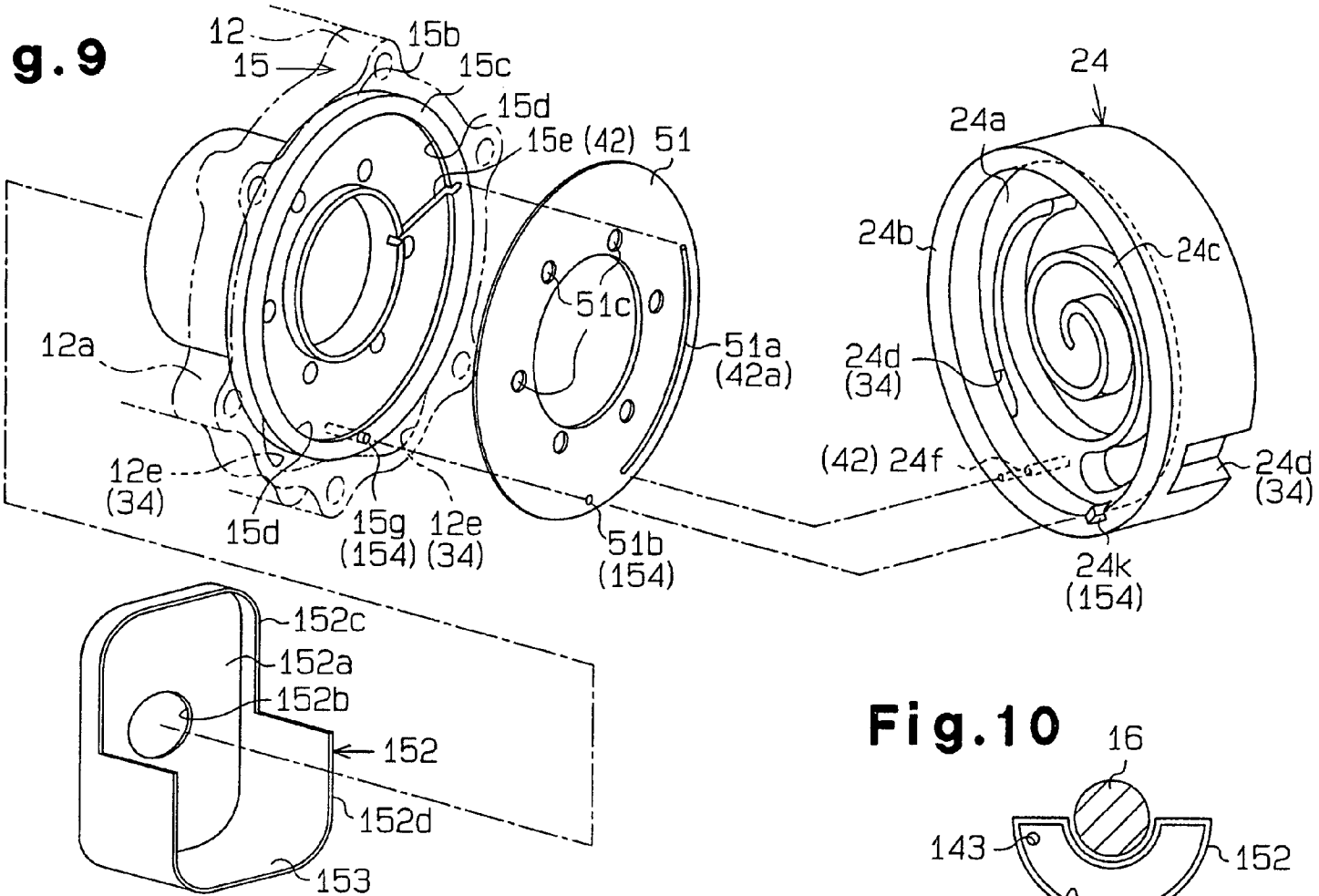
FIG. 9 is an exploded perspective view illustrating the shaft supporting member, the elastic body, the stationary scroll, and the cover shown in FIG. 6.

At the back of the shaft supporting member 15, a second reservoir chamber 153 is defined by a cover 152. The second reservoir chamber 153 retains lubricating oil drawn thereto from the back pressure chamber 41 through the oil bleed passage 143. As shown in FIG. 9, the cover 152 has a plate portion 152*a*, a shielding portion 152*c*, and a retaining portion 152*d*. A hole 152*b* for receiving the rotary shaft 16 is formed substantially in the center of the plate portion 152*a*. The shielding portion 152*c* and the retaining portion 152*d* are integrally formed with the plate portion 152*a* at the edge. The cover 152 is attached to the surface of the shaft supporting member 15, for example, by welding. The pressurized oil supply passage 42, the back pressure chamber 41 and the oil bleed passage 143 function as a communicating passage that connects the first reservoir chamber 39 with the second reservoir chamber 153.

Figure 7:
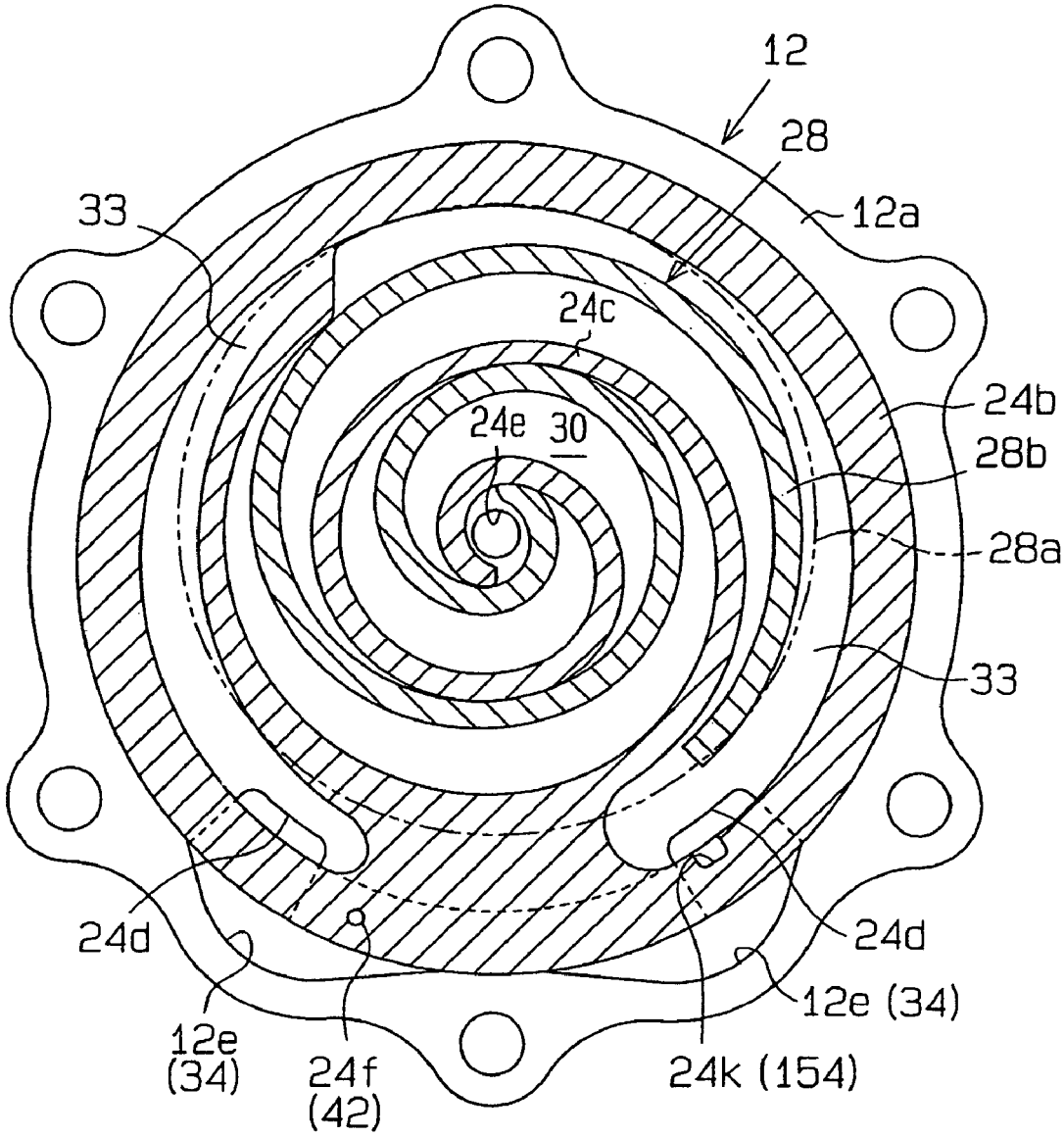
FIG. 7 is a transverse cross-sectional view illustrating a compression mechanism of the electric scroll compressor shown in FIG. 6.
Figure 8:
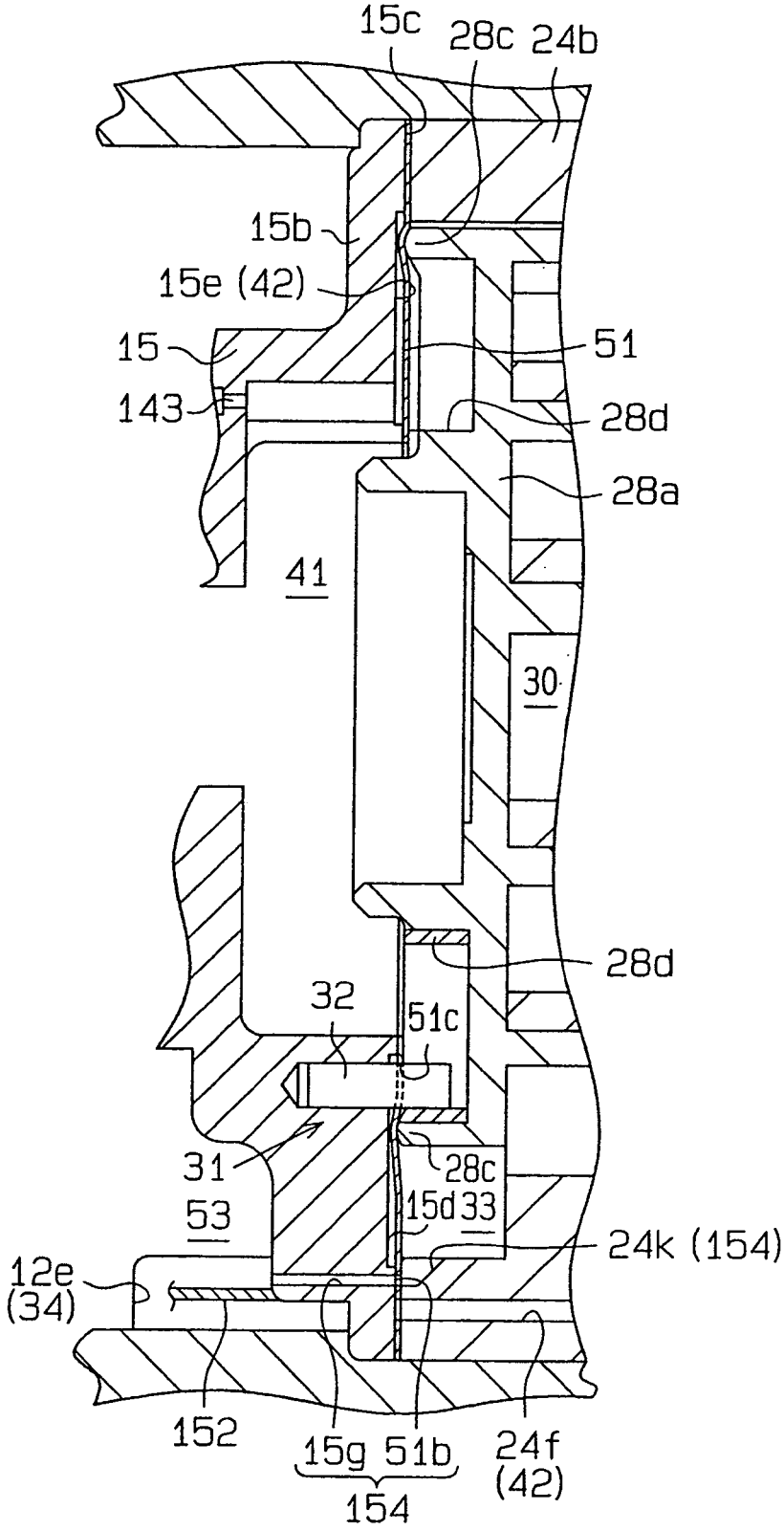
FIG. 8 is an enlarged longitudinal cross-sectional view illustrating a section including a back pressure chamber and an elastic body of the compressor shown in FIG. 6.

As shown in FIGS. 7 to 9, an oil return passage 154 is formed in the flange portion 15*b* of the shaft supporting member 15 and a lower portion of the elastic body 51. The oil return passage 154 guides lubricating oil retained in the second reservoir chamber 153 to the suction chamber 33. The oil return passage 154 includes a through hole 15*g* formed in the flange portion 15*b*, a hole 51*b* formed in a portion of the elastic body 51 that corresponds to the through hole 15*g* and a recess 24*k* formed in a portion of the distal end face of the circumferential wall 24*b* that corresponds to the hole 51*b*. Therefore, lubricating oil retained in the second reservoir chamber 153 is drawn to the suction chamber 33 through the oil return passage 154 by orbiting motion of the movable scroll 28. The lubricating oil is then drawn into the compression chamber 30 with refrigerant gas to lubricate sliding surfaces of the compression mechanism. The oil return passage 154 connects a bottom portion of the second reservoir chamber 153 with the bottom portion of the suction chamber 33.

In addition to the advantages (4)-(8) of the first embodiment, the second embodiment has the following advantages.

(9) Lubricating oil that is drawn into the back pressure chamber 41 from the first reservoir chamber 39 through the pressurized oil supply passage 42 is sent to the second reservoir chamber 153 defined in the motor accommodating chamber 20 through the oil bleed passage 143 having the adjuster valve 55. The lubricating oil is then temporarily retained in the second reservoir chamber 153. Therefore, lubricating oil is supplied from the second reservoir chamber 153 to the suction chamber 33 through the oil return passage 154. This prevents lubrication from being insufficient. In other words, the sliding surfaces of the compression mechanism, which includes the stationary scroll 24 and the movable scroll 28, are reliably lubricated.

(10) In the motor accommodating chamber 20, the second reservoir chamber 153 is defined at the back of the shaft supporting member 15 by the cover 152. The second reservoir chamber 153 temporarily retains lubricating oil. Therefore, the second reservoir chamber 153 is formed by a relatively simple structure.

(11) In the motor accommodating chamber 20, the second reservoir chamber 153 is formed by utilizing a space between the shaft supporting member 15 and the coil 21*a*. Therefore, the size of the compressor in the thrust direction does not need to be increased.

The invention may be embodied in the following forms.

Figure 10:
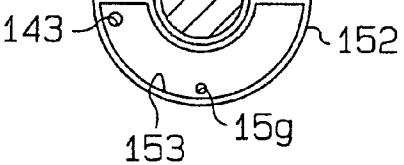
FIG. 10 is a front view illustrating a cover according to a modified embodiment of the present invention.

In the second embodiment, the shape of the cover 152 may be semicircular when viewed in the thrust direction as shown in FIG. 10, and the oil bleed passage 143 may be laterally or downwardly displaced from the rotary shaft 16 of the electric motor. The cover 152 of this modified embodiment is arranged about the rotary shaft 16. In this modified embodiment, lubrication oil that is drawn into the second reservoir chamber 153 from the oil bleed passage 143 can be retained without the lubricating oil being influenced by rotation of the rotary shaft 16.

Although not illustrated, in the second embodiment, the cover 152 may be fixed to the surface of the shaft supporting member 15 using screws with a sealing member between the cover 152 and the shaft supporting member 15.

Although not illustrated, in the second embodiment, a pipe may be connected to the outlet of the oil bleed passage 143, the pipe may be connected to a container defining the second reservoir chamber 153, and an outlet of this oil retaining container may be connected to the suction chamber 33 with an oil return passage, which is, for example, a pipe.

In the first embodiment, the shapes of the dividing walls 24*g*, 13*b* as viewed in the thrust direction may be changed, for example, to circles, ellipses, and squares.

In the first embodiment, the gas return passage 24*j* may be omitted.

In the first embodiment, the location of the oil bleed passage 54 is not limited to a middle height position in the second reservoir chamber 53. The oil bleed passage 54 may be formed in an upper end portion or a lower end portion of the second reservoir chamber 53.

In the illustrated embodiments, the connecting passage 34, which connects the motor accommodating chamber 20 with the suction chamber 33, may be formed in an upper portions of the large diameter portion 12*a* and the outer circumferential wall 24*b*. Alternatively, the connecting passage 34 may be formed in an upper end portions and a lower end portions of the large diameter portion 12*a* and the outer circumferential wall 24*b*.

In the illustrated embodiments, the rotation axis L of the electric motor 23 is arranged horizontally. However, as long as the rotation axis L is substantially horizontal, the axis L may be inclined upward or downward, for example, by 10° relative to a horizontal line.

In the illustrated embodiments, the suction port 12*f* of the first housing member 12 may be omitted, and instead, a suction port may be formed in the circumferential portion of the large diameter portion 12*a* and the outer circumferential wall 24*b* of the stationary scroll 24 to introduce refrigerant gas into the suction chamber 33.

In the illustrated embodiments, the adjuster valve 55 in each of the oil bleed passages 54, 143 may be replaced by a constriction having a smaller cross-sectional area than the constriction 42*a*.

The accommodating recess 61 may be omitted.

In the illustrated embodiments, the present invention is applied to an electric scroll compressor. However, the present invention may be applied to any type of electric compressors such as electric swash plate type compressor, an electric vane compressor, and an electric piston compressor. Alternatively, the present invention may be applied to any type of hybrid compressors, which use an electric motor and an engine as drive sources.

The present examples and embodiments are to be considered as illustrative and not restrictive and the invention is not to be limited to the details given herein, but may be modified within the scope and equivalence of the appended claims.

The invention claimed is:

1. An electric compressor, comprising:

an electric motor;

a compression mechanism that is driven by the electric motor to compress gas, wherein the compression mechanism includes a suction chamber and a discharge chamber;

a housing for accommodating the compression mechanism, wherein the housing defines a motor accommodating chamber that accommodates the electric motor, and wherein the pressure in the motor accommodating chamber is equal to the pressure in the suction chamber;

a first reservoir chamber located in the discharge chamber;

a second reservoir chamber located in the motor accommodating chamber;

a communicating passage for connecting the first reservoir chamber with the second reservoir chamber;

a restrictor located in the communicating passage;

an oil return passage for connecting the second reservoir chamber with the suction chamber;

a connecting passage for connecting the motor accommodating chamber with the suction chamber;

a partition member located in the housing, the partition member being located between the electric motor and the compression mechanism, the partition member having a face facing the motor; and a cover covering a section of the face of the partition member to define the second reservoir chamber.

2. The compressor according to claim 1, further comprising a suction passage for guiding gas from the outside of the housing to the suction chamber, wherein the motor accommodating chamber forms part of the suction passage, and wherein gas is guided into the suction chamber from the motor accommodating chamber through the connecting passage.

3. The compressor according to claim 1, wherein the motor has a rotary shaft, and the cover is arranged about the rotary shaft.

4. The compressor according to claim 1, wherein the oil return passage is formed in a lower peripheral portion of the partition member.

5. The compressor according to claim 1, wherein the compressor is of a scroll type and includes:

a stationary scroll having a stationary base plate and a stationary volute portion, wherein the stationary base plate is fixed to the housing; and a movable scroll having a movable base plate and a movable volute portion, wherein the movable scroll, together with the stationary scroll, defines a compression chamber between the volute portions, wherein the movable base plate has a first face and a second face, wherein the volute portion extends from the first face, and the second face is opposite from the first face, wherein the motor causes the movable scroll to orbit so that the compression chamber is moved toward the center of the volute portions while decreasing the volume, whereby gas is compressed.

6. The compressor according to claim 5, wherein the surface of the movable scroll is plated with nickel phosphorus.

7. The compressor according to claim 5, wherein the partition member faces the second face of the movable scroll, wherein the second face and the partition member define a back pressure chamber, wherein an elastic body is located between the second face and the partition member, the elastic body urging the movable scroll toward the stationary scroll, and wherein the elastic body seals the back pressure chamber and the suction chamber from each other.

8. The compressor according to claim 7, wherein the elastic body is a doughnut-shaped plate.

9. The compressor according to claim 7, wherein an annular projection extends from the second face of the movable scroll, and wherein the annular projection is pressed against the elastic body, thereby sealing the back pressure chamber.

10. The compressor according to claim 1, wherein the oil return passage extends from a bottom portion of the second reservoir chamber to the suction chamber.

11. The compressor according to claim 1, wherein the oil return passage connects the second reservoir chamber with a bottom portion of the suction chamber.

12. The compressor according to claim 1, wherein the restrictor includes a valve that operates according to the difference between a pressure in the first reservoir chamber and a pressure in the second reservoir chamber.

13. The compressor according to claim 1, wherein the restrictor includes a check valve that prevents backflow of oil from the second reservoir chamber to the first reservoir chamber.

14. The compressor according to claim 1, wherein the motor has an axis of rotation that extends substantially horizontally.

15. The compressor according to claim 1, wherein the connecting passage connects a bottom portion of the motor accommodating chamber with the suction chamber.

16. An electric compressor, comprising:

an electric motor;

a compression mechanism that is driven by the electric motor to compress gas, wherein the compression mechanism includes a suction chamber and a discharge chamber;

a housing for accommodating the compression mechanism, wherein the housing defines a motor accommodating chamber that accommodates the electric motor, and wherein the pressure in the motor accommodating chamber is equal to the pressure in the suction chamber;

a first reservoir chamber located in the discharge chamber;

a second reservoir chamber located in the motor accommodating chamber;

a communicating passage for connecting the first reservoir chamber with the second reservoir chamber;

a restrictor located in the communicating passage;

an oil return passage for connecting the second reservoir chamber with the suction chamber; and a connecting passage for connecting the motor accommodating chamber with the suction chamber, wherein the compressor is of a scroll type and includes:

a stationary scroll having a stationary base plate and a stationary volute portion, wherein the stationary base plate is fixed to the housing; and a movable scroll having a movable base plate and a movable volute portion, wherein the movable scroll, together with the stationary scroll, defines a compression chamber between the volute portions, wherein the movable base plate has a first face and a second face, wherein the volute portion extends from the first face, and the second face is opposite from the first face, wherein the motor causes the movable scroll to orbit so that the compression chamber is moved toward the center of the volute portions while decreasing the volume, whereby gas is compressed, wherein a partition member is located in the housing to face the second face of the movable scroll, wherein the second face and the partition member define a back pressure chamber;

wherein the communicating passage includes the back pressure chamber, a pressurized oil supply passage for connecting the back pressure chamber with the first reservoir chamber, and an oil bleed passage for connecting the back pressure chamber with the second reservoir chamber, and wherein the restrictor is located in at least one of the pressurized oil supply passage and the oil bleed passage.

17. The compressor according to claim 16, wherein the restrictor has a constriction located in the pressurized oil passage, and a constriction or an adjuster valve located in the oil bleed passage.

* * * * *